US010303077B2

(12) United States Patent
Saito

(10) Patent No.: US 10,303,077 B2
(45) Date of Patent: May 28, 2019

(54) IMAGE FORMING APPARATUS THAT DETERMINES LIFETIME OF INTERMEDIATE TRANSFER BELT

(71) Applicant: CANON KABUSHIKI KAISHA, Tokyo (JP)

(72) Inventor: Tomohiro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/911,526

(22) Filed: Mar. 5, 2018

(65) Prior Publication Data

US 2018/0259869 A1 Sep. 13, 2018

(30) Foreign Application Priority Data

Mar. 8, 2017 (JP) ..... 2017-044170

(51) Int. Cl.
*G03G 15/00* (2006.01)
*G03G 15/01* (2006.01)
*G03G 15/02* (2006.01)

(52) U.S. Cl.
CPC ..... *G03G 15/0189* (2013.01); *G03G 15/0216* (2013.01); *G03G 15/50* (2013.01)

(58) Field of Classification Search
CPC ..... G03G 15/0189; G03G 15/0216
USPC ..... 399/302
See application file for complete search history.

(56) References Cited

U.S. PATENT DOCUMENTS 9,268,282 B2 2/2016 Saito et al.
2012/0155902 A1* 6/2012 Torimaru ..... G03G 15/657 399/66

FOREIGN PATENT DOCUMENTS

JP 2006-030233 A 2/2006
JP 2008-020661 A 1/2008
JP 2015-135469 A 7/2015

* cited by examiner

*Primary Examiner* — Susan S Lee
(74) *Attorney, Agent, or Firm* — Venable LLP

(57) ABSTRACT

An image forming apparatus includes a photoconductor, an intermediate transfer belt, a metal transfer roller configured to transfer a toner image carried on the photoconductor to the intermediate transfer belt at a transfer position when a voltage is applied from a power supply, a detection portion configured to detect a current flowing when a voltage is applied to the transfer roller from the power supply, and a controller. The controller is capable of executing a mode in which a plurality of voltages higher than a discharge starting voltage is applied from the power supply to the transfer roller during a period other than a transfer period when the toner image carried on the photoconductor is transferred to the intermediate transfer belt. The controller is configured to output information regarding a lifetime of the intermediate transfer belt based on a current flowing when the plurality of voltages is applied to the transfer roller.

9 Claims, 10 Drawing Sheets

IMAGE FORMING APPARATUS THAT DETERMINES LIFETIME OF INTERMEDIATE TRANSFER BELT

BACKGROUND OF THE INVENTION

Field of the Invention

The present invention relates to an image forming apparatus such as an electrophotographic copying machine, and an electrophotographic printer (for example, a laser beam printer and an LED printer).

Description of the Related Art

In an electrophotographic system image forming apparatus, an intermediate tandem system using an intermediate transfer belt (intermediate transfer member) has been widely adopted. The intermediate tandem system image forming apparatus performs primary transfer of toner images of yellow, magenta, cyan, and black, superimposes them on the intermediate transfer belt to form a full-color toner image, and then performs secondary transfer of the full-color toner image on a sheet.

Here, the primary transfer is performed by applying a primary transfer bias to a primary transfer roller arranged opposite to a photosensitive drum with the intermediate transfer belt interposed therebetween. For this reason, it is important to grasp electrical characteristics of the intermediate transfer belt when the intermediate transfer belt is manufactured or mounted on the image forming apparatus.

These electrical characteristics are generally measured based on the JIS K 6911 method and evaluated using a surface resistivity and volume resistivity. The surface resistivity is calculated by pressing an electrode (probe) against a surface of a sample and detecting a current flowing on the surface, and a volume resistivity is derived by measuring the current flowing between the electrodes on and under the sample.

Further, electric resistance of the intermediate transfer belt sometimes changes with an image forming operation. In a widely known intermediate transfer belt in which a material where conductive particles such as carbon black are dispersed in a thermoplastic resin or thermosetting resin such that the material is adjusted to have a desired resistance is formed into a belt shape, the following is conceivable as one of causes of the change in electric resistance.

That is, in a resin belt including the conductive particles, in a transfer step, micro discharge occurs between a sheet charged with transfer charges and the intermediate transfer belt, and the charges are moved from the sheet to the intermediate transfer belt, whereby conductive particles on the surface of the intermediate transfer belt are charged. Then, an electric field is locally generated between the charged conductive particle and another conductive particle in the vicinity thereof, and in a case where the electric field is strong, discharge occurs between the two conductive particles. In this case, a resin portion sandwiched by the conductive particles is decomposed and carbonized due to heat generated by the discharge and the insulating property is lost, and as a result, the resin portion becomes a conductor. Such dielectric breakdown in a local area gradually expands and the surface resistivity decreases as the transfer step accompanying the image formation is repeated.

In a case where the electric resistance of the intermediate transfer belt changes in this manner, an image defect may occur due to this change. FIG. 10 is a graph showing a relationship between a primary transfer current at which a void image occurs and a splattering rank according to a difference in the surface resistivity of the intermediate transfer belt. As shown in FIG. 10, in a case where the surface resistivity of the intermediate transfer belt is too small, splattering of toner becomes conspicuous. On the other hand, in a case where the surface resistivity of the intermediate transfer belt is too large, local discharge is likely to occur and a local void image occurs in an image. Therefore, it is desirable that the intermediate transfer belt is used within an appropriate range of the electric resistance.

Therefore, detection of a change in the electric resistance of the intermediate transfer belt makes it possible to address the image defect as described above. To address the image defect as described above, Japanese Patent Laid-Open No. 2008-20661 proposes a configuration in which discharge light generated at the time of transfer from an end of a transfer member is detected by using a transparent intermediate transfer belt and the transfer member including an optically anisotropic material, and electric resistance characteristics of the intermediate transfer belt are checked.

However, in the configuration described in Japanese Patent Laid-Open No. 2008-20661, in order to check the electric resistance characteristics of the intermediate transfer belt, a material having special optical characteristics must be used for the intermediate transfer belt and the transfer member, leading to a constraint of the material and an increase in a cost.

SUMMARY OF THE INVENTION

It is desirable to provide an image forming apparatus capable of suppressing an image defect caused by a change in an electric resistance of an intermediate transfer member with a low cost and a simple configuration.

A representative configuration of the present invention is an image forming apparatus including:

a photoconductor configured to carry a toner image;

an intermediate transfer belt on which the toner image carried on the photoconductor is transferred;

a metal transfer roller which is disposed to abut on an inner peripheral surface of the intermediate transfer belt such that, when viewed from a thickness direction of the intermediate transfer belt, an abutting position between the metal transfer roller and the intermediate transfer belt does not overlap an abutting position between the photoconductor and the intermediate transfer belt, the metal transfer roller being configured to transfer the toner image carried on the photoconductor to the intermediate transfer belt at a transfer position when a voltage is applied from a power supply;

a detection portion configured to detect a current flowing when a voltage is applied to the transfer roller from the power supply; and a controller capable of executing a mode in which a plurality of voltages higher than a discharge starting voltage is applied from the power supply to the transfer roller during a period other than a transfer period when the toner image carried on the photoconductor is transferred to the intermediate transfer belt, the controller being configured to output information regarding a lifetime of the intermediate transfer belt based on a current flowing when the plurality of voltages is applied to the transfer roller.

Further features of the present invention will become apparent from the following description of exemplary embodiments with reference to the attached drawings.

DESCRIPTION OF THE EMBODIMENTS

First Embodiment

<Image Forming Apparatus>

Hereinafter, an overall configuration of an image forming apparatus according to a first embodiment of the present invention will be described with reference to the drawings together with an operation at the time of image formation. Note that dimensions, materials, shapes, relative dispositions, and the like of the described components are not intended to limit the scope of the present invention unless otherwise specified.

An image forming apparatus A is an intermediate transfer tandem system color image forming apparatus in which an image is transferred onto a sheet to be formed after toners of four colors of yellow Y, magenta M, cyan C, and black K are transferred onto an intermediate transfer belt. In the following description, while Y, M, C, and K are added as subscripts to members using the toner of each color described above, configurations or operations of the members are substantially the same except that colors of the toner are different from each other. Therefore, the subscripts are omitted as appropriate unless distinction is required.

Figure 1:
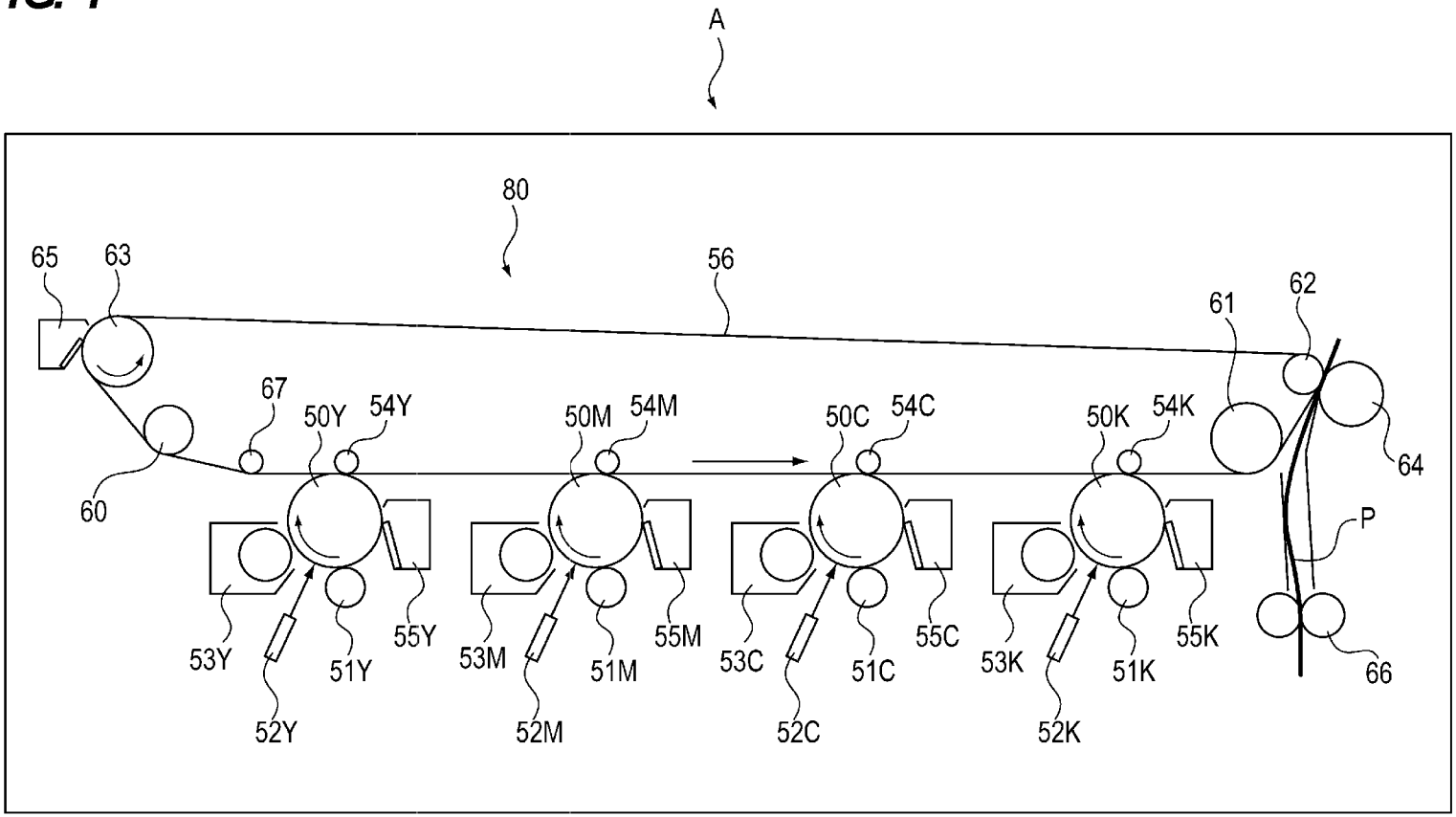
FIG. 1 is a schematic cross-sectional view of an image forming apparatus.

As illustrated in FIG. 1, the image forming apparatus A includes an image forming portion which forms an image by transferring a toner image to a sheet P as a recording material, a sheet feeding portion which feeds the sheet P to the image forming portion, and a fixing portion which fixes the toner image on the sheet P.

The image forming portion includes photosensitive drums 50 (50Y, 50M, 50C, and 50K) and charging rollers 51 (51Y, 51M, 51C, and 51K) which charge a surface of the photosensitive drum 50. The image forming portion also includes drum cleaners 55 (55Y, 55M, 55C, and 55K), laser scanner units 52 (52Y, 52M, 52C, and 52K), developing devices 53 (53Y, 53M, 53C, and 53K), and an intermediate transfer unit 80.

The intermediate transfer unit 80 includes primary transfer rollers 54 (54Y, 54M, 54C, and 54K), an intermediate transfer belt 56, a secondary transfer roller 64, a secondary transfer counter roller 62, a driving roller 63, a tension roller 60, idler rollers 61 and 67, a belt cleaner 65, and the like.

Figure 3:
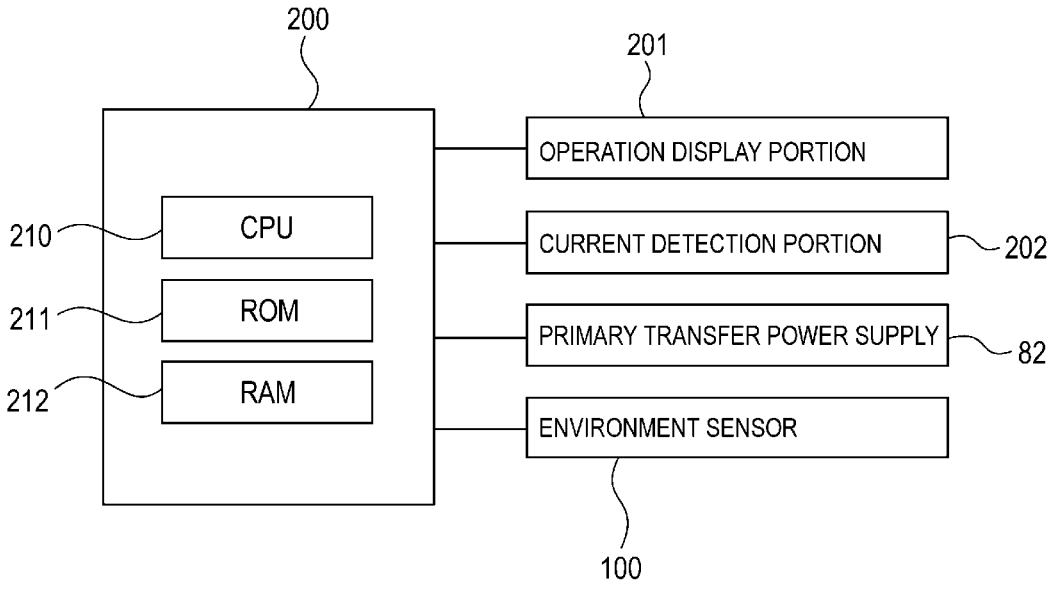
FIG. 3 is a block diagram illustrating a system configuration of the image forming apparatus.

Further, an IC tag (not illustrated) is provided in the intermediate transfer unit 80, and a controller 200 illustrated in FIG. 3 can store information in this IC tag or acquire information from the IC tag. Further, the intermediate transfer unit 80 is configured to be detachably attachable to a main body of the image forming apparatus A, and can be exchanged as appropriate.

The intermediate transfer belt 56 (intermediate transfer member) is a film-like endless belt having a surface resistivity of $5\times10^{10}$ to $1\times10^{12}\Omega/\square$ and a thickness of 40 to 60 μm in an initial state. The intermediate transfer belt 56 to be used includes a material in which an appropriate amount of a conductive filler such as carbon or an ionic conductive material is contained and dispersed in a resin such as polyimide or polyamide, a rubber, or the like.

The intermediate transfer belt 56 is stretched by the primary transfer roller 54, the secondary transfer counter roller 62, the driving roller 63, the tension roller 60, and the idler rollers 61 and 67. Further, the intermediate transfer belt 56 moves circularly at a speed of 200 mm/s by following rotation of the driving roller 63 driven by a motor (not illustrated) excellent in a constancy of speed. Note that, in the present embodiment, the tension roller 60 which applies tension to the intermediate transfer belt 56 is configured such that belt tension is about 3 to 12 kgf. Further, the intermediate transfer belt 56 is configured to be detachably attachable to the main body of the image forming apparatus A (main body of the image forming apparatus).

The secondary transfer counter roller 62 is made of EPDM rubber and is formed to have a roller diameter of 20 mm and a rubber thickness of 0.5 mm, and hardness is set to 70° in Asker C hardness. Further, the secondary transfer roller 64 is formed of an elastic layer made of NBR rubber, EPDM rubber, or the like and a metal core, and is formed to have a roller diameter of 24 mm. A high voltage power supply (not illustrated) is attached to the secondary transfer roller 64, and voltage to be applied is variable.

The primary transfer roller 54 (transfer roller) is a metal roller member having a roller diameter of 6 to 10 mm and a straight shape in a thrust direction. In the present embodiment, SUM+KN plating or SUS is used as a material of the primary transfer roller 54. A primary transfer power supply 82 is connected to the primary transfer roller 54.

Figure 2:
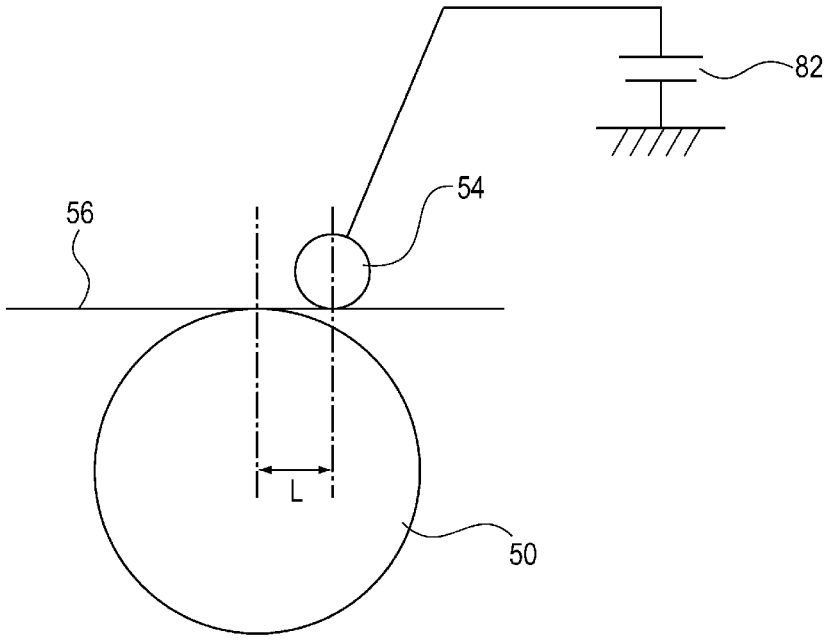
FIG. 2 is a schematic cross-sectional view of a primary transfer portion.

FIG. 2 is a schematic cross-sectional view of the primary transfer portion formed by the photosensitive drum 50 and the primary transfer roller 54. As illustrated in FIG. 2, the primary transfer roller 54 is arranged to face the photosensitive drum 50 via the intermediate transfer belt 56 at a position downstream of the photosensitive drum 50 in a moving direction of the intermediate transfer belt 56. Further, the primary transfer roller 54 abuts on an inner peripheral surface of the intermediate transfer belt 56. In the present embodiment, a distance L between a vertical line with respect to the intermediate transfer belt 56 drawn from a center axis of the photosensitive drum 50 and a vertical line with respect to the intermediate transfer belt 56 drawn from a center axis of the primary transfer roller 54 is 7 mm. That is, in the moving direction of the intermediate transfer belt 56, an abutting position between the primary transfer roller 54 and the intermediate transfer belt 56 is arranged downstream of an abutting position between the photosensitive drum 50 and the intermediate transfer belt 56. More specifically, in the moving direction of the intermediate transfer belt 56, an upstream end position of an abutting area between the primary transfer roller 54 and the intermediate transfer belt 56 is arranged downstream of the downstream end position of an abutting area between the photosensitive drum 50 and the intermediate transfer belt 56. This makes it possible to prevent the photosensitive drum 50 from being flawed even in a case where the primary transfer roller 54 is made of a rigid body such as a metal roller.

The primary transfer roller 54 is pressed against the intermediate transfer belt 56 so as to make 0.1 to 0.3 mm inroads into the intermediate transfer belt 56. This pressing is performed by application of a force to a bearing supporting an end of the primary transfer roller 54 toward a photosensitive drum 50 side by a spring (not illustrated).

Next, an image forming operation will be described. First, when the controller 200 illustrated in FIG. 3 receives an image forming job signal, the sheet P stacked and stored in a sheet feeding cassette (not illustrated) is conveyed to the image forming portion by a feeding roller (not illustrated) and a registration roller 66.

Meanwhile, in the image forming portion, a voltage is applied to the charging roller 51, whereby the surface of the photosensitive drum 50 is charged. Thereafter, light intensity is set according to a toner output signal (image signal) transmitted from an external device or the like (not illustrated), the laser scanner unit 52 irradiates the surface of the photosensitive drum 50 with laser light, and an electrostatic latent image is formed on the surface of the photosensitive drum 50.

Thereafter, toner is attached to the electrostatic latent image formed on the surface of the photosensitive drum 50 by the developing device 53, and the toner image is formed on the surface of the photosensitive drum 50. In this manner, the toner image is carried on the photosensitive drum 50 of each color. The toner image formed on the surface of the photosensitive drum 50 is sent to the primary transfer portion (transfer position) formed by the photosensitive drum 50 and the primary transfer roller 54.

A primary transfer voltage having opposite-polarity to charging polarity of the toner is applied from the primary transfer power supply 82 to the primary transfer roller 54, whereby the toner image sent to the primary transfer portion is primarily transferred to the intermediate transfer belt 56. As a result, the toner images of respective colors are sequentially superimposed on the intermediate transfer belt 56 to form a full-color toner image. Note that, in the present embodiment, normal charging polarity of the toner is negative, charging polarity of the photosensitive drum 50 is negative, and polarity of a primary transfer bias is positive.

Thereafter, the toner image is sent to a secondary transfer portion formed by the secondary transfer roller 64 and the secondary transfer counter roller 62 by rotation of the intermediate transfer belt 56. In the secondary transfer portion, a secondary transfer voltage having the opposite-polarity to the charging polarity of the toner is applied to the secondary transfer roller 64, whereby the toner image on the intermediate transfer belt 56 is transferred to the sheet P. That is, the toner image transferred from the photosensitive drum 50 and to the sheet P is temporarily carried on the intermediate transfer belt 56.

The sheet P to which the toner image has been transferred is sent to a fixing device (not illustrated), heated and pressed, whereby the toner image is fixed on the sheet P. Thereafter, the sheet P is discharged to the outside of the image forming apparatus A.

Note that the toner remaining on the surface of the photosensitive drum 50 after the primary transfer is scraped off with the drum cleaner 55 and removed. Similarly, the toner remaining on an outer peripheral surface of the intermediate transfer belt 56 after the secondary transfer is scraped off with the belt cleaner 65 and removed.

<Controller>

Next, an outline of a system configuration of the image forming apparatus A will be described.

FIG. 3 is a block diagram illustrating a part of the system configuration of the image forming apparatus A. As illustrated in FIG. 3, the image forming apparatus A includes the controller 200 including a CPU 210, a ROM 211, and a RAM 212. Further, the controller 200 is connected to an operation display portion 201 (display portion), a current detection portion 202 (detection portion), the primary transfer power supply 82 (power supply), and an environment sensor 100.

The ROM 211 stores a control program, various types of data, a table, and the like. The CPU 210 performs various types of arithmetic processing based on the control program and information stored in the ROM 211. The RAM 212 includes a program load area, a work area, a storage area for the various types of data, and the like.

In other words, in the controller 200, the CPU 210 controls each device of the image forming apparatus A while using the RAM 212 as the work area based on the control program stored in the ROM 211. Then, through the control of each device, the image forming operation described above such as formation of the toner image on the photosensitive drum 50 can be executed.

The operation display portion 201 displays a message to a user, a menu screen, and the like, and can make various settings by a user operation. Further, the user can operate the operation display portion 201 to execute an image forming job, and the controller 200 receives signals from the operation display portion 201 to operate various devices of the image forming apparatus A.

The primary transfer power supply 82 is controlled by the controller 200 and applies a predetermined primary transfer voltage to the primary transfer roller 54.

The environment sensor 100 detects temperatures and humidity of environment in which the image forming apparatus A is used, and outputs the data to the controller 200.

The current detection portion 202 detects a value of the primary transfer current flowing when the voltage is applied from the primary transfer power supply 82 to the primary transfer roller 54. The current detection portion 202 measures the current flowing through a resistor element (not illustrated) for current detection disposed in a high voltage board of the primary transfer power supply 82 with a current measuring instrument (not illustrated) in the high voltage board to measure the current value.

<Resistance Detection Mode>

Next, a resistance detection mode which detects the surface resistivity as the electric resistance of the intermediate transfer belt 56 will be described. As described above, in the present embodiment, the primary transfer roller 54 is the metal roller. Further, as illustrated in FIG. 2, the primary transfer roller 54 and the photosensitive drum 50 are offset with respect to a conveyance direction of the intermediate transfer belt 56 such that the photosensitive drum 50 is not flawed by the metal roller. In other words, when viewed from a thickness direction of the intermediate transfer belt 56, the abutting area between the primary transfer roller 54 and the intermediate transfer belt 56 and the abutting area between the photosensitive drum 50 abutting on the intermediate transfer belt 56 are offset so as not to overlap with each other. It has been found that in such a configuration, a current-voltage characteristic, which is the relationship between a voltage and a current flowing when the voltage is applied to the primary transfer roller 54, is changed due to a variation in a length of the intermediate transfer belt 56 stretched between the primary transfer roller 54 and the photosensitive drum 50 in the moving direction. Specifically, a gradient of the current-voltage characteristic changes. Therefore, it is difficult to accurately predict the resistance value of the intermediate transfer belt 56 from the change in the current-voltage characteristic when the voltage is applied to the primary transfer roller 54. Therefore, in the present embodiment, attention is paid to a discharge starting voltage which is a voltage at which the current starts to flow to the photosensitive drum 50 when the voltage is applied to the primary transfer roller 54, thereby accurately predicting the resistance value of the intermediate transfer belt 56.

Figure 4:
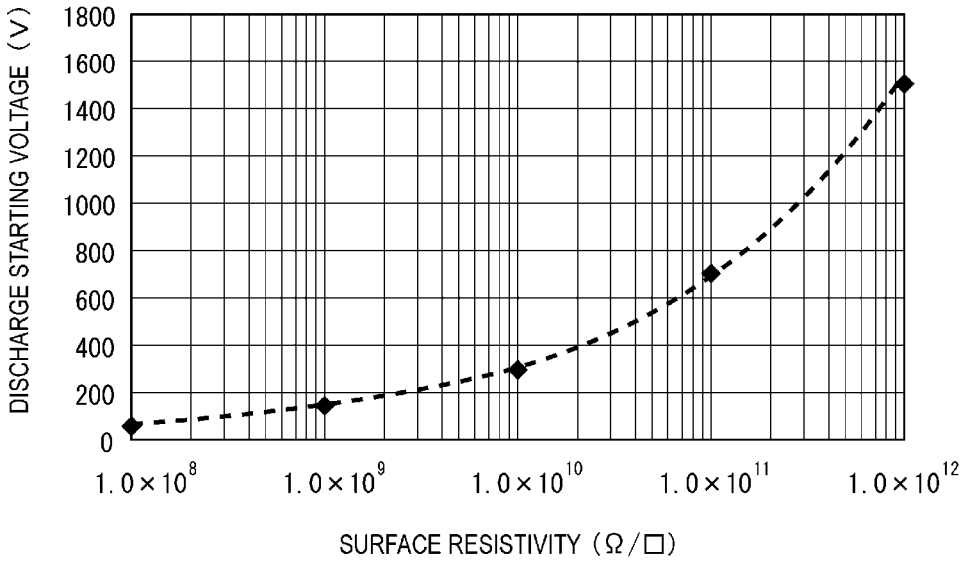
FIG. 4 is a graph showing a relationship between a surface resistivity of an intermediate transfer belt and a discharge starting voltage.

FIG. 4 is a graph showing a relationship between the discharge starting voltage which is the voltage at which the current starts to flow from the primary transfer roller 54 to the photosensitive drum 50 via the intermediate transfer belt 56 when the voltage is applied from the primary transfer power supply 82, and the surface resistivity of the intermediate transfer belt 56. This discharge starting voltage can also be a voltage at which discharge is started between the intermediate transfer belt 56 and the photosensitive drum 50 when the voltage is applied from the primary transfer power supply 82 to the primary transfer roller 54. As shown in FIG. 4, there is correlation between the discharge starting voltage and the surface resistivity of the intermediate transfer belt 56, and as the surface resistivity of the intermediate transfer belt 56 increases, the discharge starting voltage increases. The reason for this is that the primary transfer roller 54 is the metal roller. This is because if the primary transfer roller 54 is a sponge roller, correlation between the discharge starting voltage and the resistance value of the intermediate transfer belt 56 is lost due to resistance variation of the primary transfer roller 54.

Therefore, in the present embodiment, the controller 200 as an executing portion executes the resistance detection mode to derive the discharge starting voltage, and referring to the derived discharge starting voltage and correlation data shown in FIG. 4, which is previously stored in the ROM 211 (memory), detects the surface resistivity of the intermediate transfer belt 56. Note that the resistance detection mode is performed during a period in which there is no toner image on the primary transfer portion, that is, when the primary transfer roller 54 is not transferred. Hereinafter, content of the resistance detection mode will be described with reference to a flowchart of FIG. 5.

Figure 5:
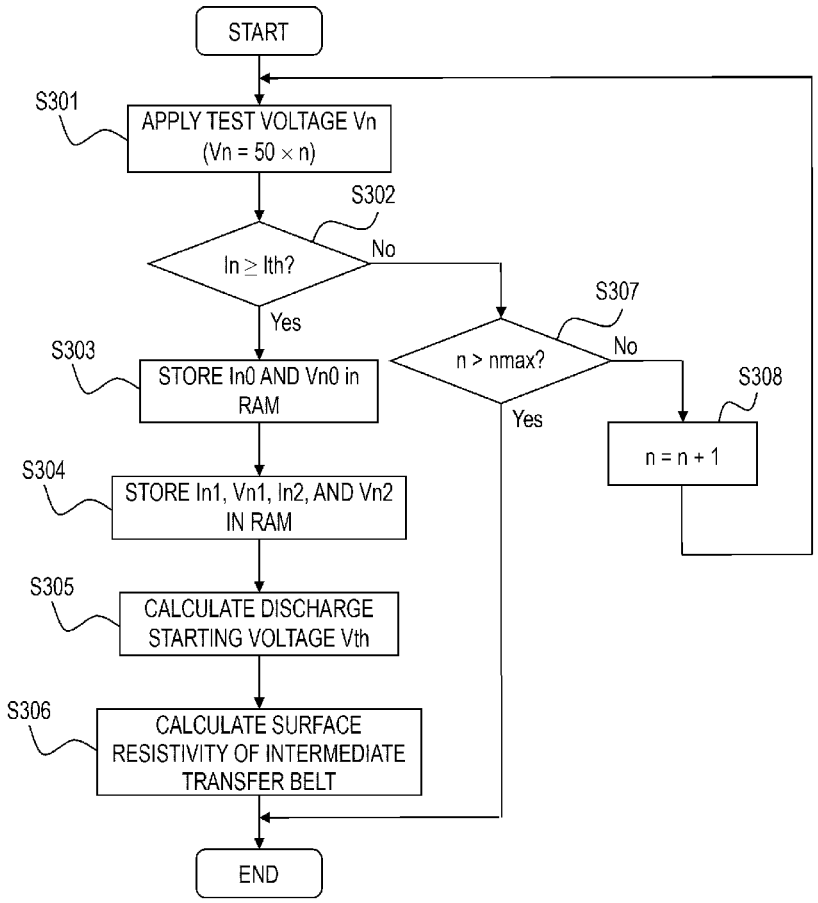
FIG. 5 is a flowchart of a resistance detection mode.

As indicated in FIG. 5, first, when the resistance detection mode is started, the controller 200 applies a test voltage Vn from the primary transfer power supply 82 to the primary transfer roller 54 (S301). A value of the test voltage Vn is determined from Vn=50×n (V), where the number of tests is n (integer). An initial value of the number of tests n is "1".

Next, the controller 200 measures, by the current detection portion 202, a current value In of the primary transfer current flowing through the intermediate transfer belt 56 to the photosensitive drum 50 when the test voltage Vn is applied to the primary transfer roller 54. Then, it is determined whether the current value In is equal to or larger than a current value ΔIth (equal to or larger than a predetermined value) previously stored in the ROM 211 (S302). Here, the current value ΔIth is a current value at which it can be determined in consideration of an error in measurement that the primary transfer current flows in the photosensitive drum 50 with a voltage equal to or higher than the discharge starting voltage applied. The current value ΔIth is 2 μA in the present embodiment.

Here, in a case where the current value In is less than the current value ΔIth, the controller 200 determines whether the number of tests n is larger than nmax (S307). Here, nmax is the number of tests in which the test voltage Vn needs not be increased further. That is, in the present embodiment, from the graph shown in FIG. 4, the surface resistivity of the intermediate transfer belt 56 is $1\times10^{10}\Omega/\square$ or more, which is an initial specification as long as the discharge starting voltage is 300 V or more and it is considered that the resistance is not decreased. The test voltage Vn reaches 300 V when n=6. Therefore, nmax=6, and in a case where the number of tests n is larger than nmax (=6), it is determined that surface resistance of the intermediate transfer belt 56 is $1\times10^{10}\Omega/\square$ or more and the resistance detection mode ends.

On the other hand, in a case where the number of tests n is less than nmax, returning to step S301 again after setting the number of tests n to "n+1" (S308), the test voltage Vn which is 50 V higher than the previous one is applied. In this way, the test voltage Vn is gradually increased.

When the current value In exceeds the current value ΔIth, the test voltage Vn at that time is stored as Vn0 and the current value In is stored as In0 in the RAM 212 (S303). Thereafter, the test voltage Vn1 where n=n+1 relative to the test voltage Vn is further applied, and the current value In1 flowing at that time is measured and stored in the RAM 212 (S304). Thereafter, the test voltage Vn2 where n=n+1 relative to the test voltage Vn1 is further applied, and the current value In2 flowing at that time is measured and stored in the RAM 212 (S304).

Figure 6:
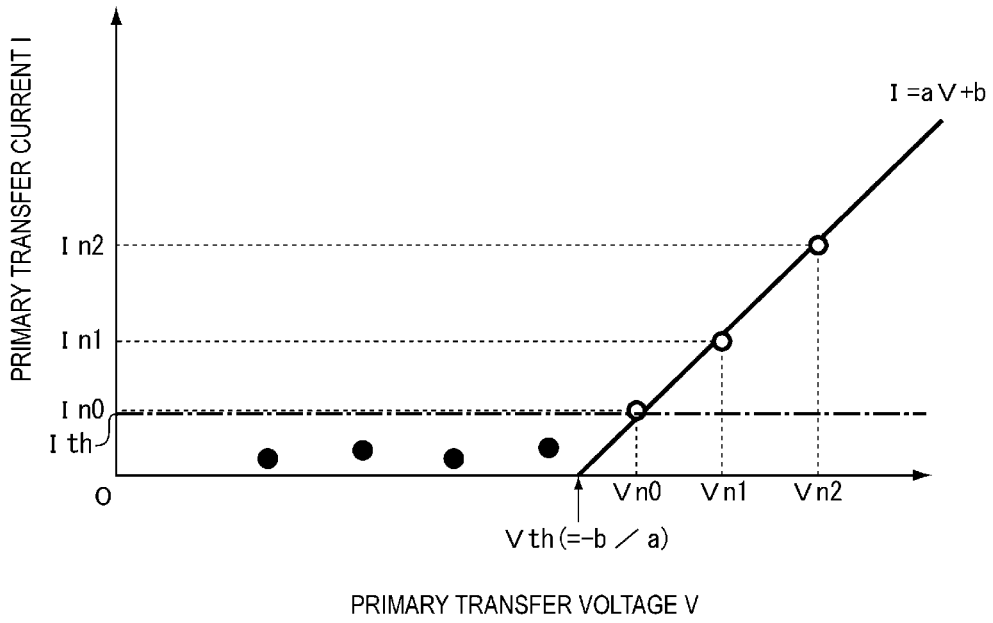
FIG. 6 is a graph showing a relationship between a primary transfer current and a primary transfer voltage measured in the resistance detection mode.

Next, as shown in FIG. 6, the controller 200 calculates, from three points of "Vn0–In0", "Vn1–In1", and "Vn2–In2", I=aV+b as a linear approximate expression relating to a primary transfer current I and a primary transfer voltage V by a least squares method. Thereafter, a discharge starting voltage Vth (=−b/a) is calculated from this linear approximate expression (S305).

That is, the controller 200 applies voltages of at least two values at which the current value detected by the current detection portion 202 is ΔIth (predetermined value) or more from the primary transfer power supply 82 to the primary transfer roller 54, and derives the discharge starting voltage Vth based on a relationship between the current and the voltage at that time. That is, the controller 200 applies a plurality of voltages higher than the discharge starting voltage Vth from the primary transfer power supply 82 to the primary transfer roller 54 during a period other than a transfer period in which the toner image on the photosensitive drum 50 is transferred to the intermediate transfer belt 56. Then, the discharge starting voltage Vth is derived based on a relationship between the current and the voltage at that time. Specifically, the relationship between the current and the voltage in the case where the current value detected by the current detection portion 202 is ΔIth or more is linearly approximated, and a voltage value in a case where the current value in the approximated relationship between the current and the voltage is zero is set as the discharge starting voltage Vth.

Next, the controller 200 calculates the surface resistivity of the intermediate transfer belt 56 based on the calculated discharge starting voltage Vth and the correlation data shown in FIG. 4 previously stored in the ROM 211 (S306), and ends the resistance detection mode. Note that the controller 200 stores information on the number of execution times of the resistance detection mode in the IC tag (not illustrated) included in the intermediate transfer unit 80.

Note that a positional relationship between the primary transfer roller 54 and the photosensitive drum 50 illustrated in FIG. 2 can vary due to design tolerance or the like. However, in the resistance detection mode, a minute current flowing at a voltage close to the discharge starting voltage due to the discharge between the photosensitive drum 50 and the intermediate transfer belt 56 is detected. For this reason, it is possible to measure ease of discharge between the photosensitive drum 50 and the intermediate transfer belt 56 by minimizing an influence of a voltage drop due to a divided voltage of resistance of the intermediate transfer belt 56. Therefore, it is possible to detect the surface resistivity of the intermediate transfer belt 56 without being affected by variation of the position of the primary transfer roller 54.

Further, in the present embodiment, in the resistance detection mode, the relationship between the current and the voltage in a case where the current value detected by the current detection portion 202 is ΔIth or more is linearly approximated, and the voltage value in the case where the current value in the approximated relationship between the current and the voltage is zero is set as the discharge starting voltage Vth. Then, the surface resistivity of the intermediate transfer belt 56 is detected based on the discharge starting voltage Vth. However, the present invention is not limited to the present embodiment, and may adopt the configuration in which the surface resistivity of the intermediate transfer belt 56 is detected based on a value related to another discharge starting voltage. Here, the value related to the discharge starting voltage is a value derived from the relationship between the current and the voltage applied to the primary transfer roller 54 from the primary transfer power supply 82 when there is no toner image on the primary transfer portion.

<Lifetime Detection Mode>

Next, a lifetime detection mode which detects a lifetime of the intermediate transfer belt 56 from the surface resistivity (electric resistance) of the intermediate transfer belt 56 detected in the resistance detection mode will be described with reference to a flowchart of FIG. 7.

Figure 7:
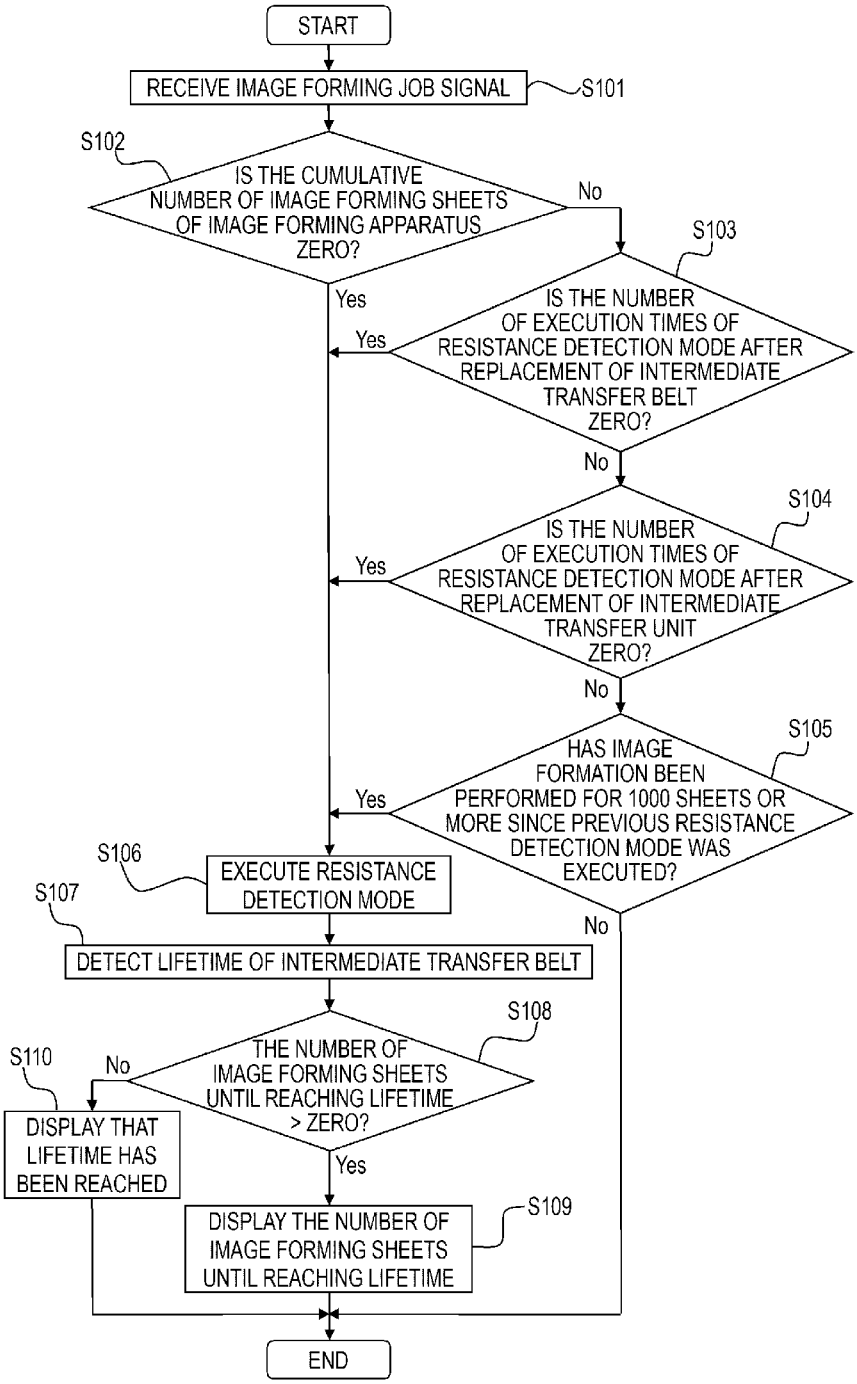
FIG. 7 is a flowchart of a lifetime detection mode.

As indicated in FIG. 7, when an image forming job signal is received (S101), the controller 200 determines whether the cumulative number of image forming sheets of the image forming apparatus A is zero at the time of the previous rotation based on the information on the number of image forming sheets stored in the RAM 211 (S102).

Next, in a case where the cumulative number of image forming sheets is not zero, the controller 200 determines whether the number of execution times of the resistance detection mode after replacement of the intermediate transfer belt 56 is zero (S103). Detection of the replacement of the intermediate transfer belt 56 is performed when information that the replacement has been performed after the replacement of the intermediate transfer belt 56 is input to the controller 200 through the operation display portion 201. Further, whether the resistance detection mode has been executed is determined based on the information stored in the IC tag (not illustrated) of the intermediate transfer unit 80.

Next, in a case where the resistance detection mode has been executed after the replacement of the intermediate transfer belt 56, the controller 200 determines whether the number of execution times of the resistance detection mode after replacement of the intermediate transfer unit 80 is zero (S104). Detection of the replacement of the intermediate transfer unit 80 is performed when information that the replacement has been performed after the replacement of the intermediate transfer unit 80 is input to the controller 200 through the operation display portion 201.

Next, in a case where the resistance detection mode is executed after replacing the intermediate transfer unit 80, the controller 200 determines whether the present cumulative number of image forming sheets is 1000 or more sheets larger than the cumulative number of image forming sheets (on an A4 conversion basis) when the resistance detection mode was last executed (S105). Here, in a case where 1000 or more sheets of images are not formed since the resistance detection mode was executed last time, the controller 200 ends a lifetime detection sequence.

Meanwhile, in a case where the determination is YES in any of the above steps S102 to S105, the resistance detection mode is executed to detect the surface resistivity of the intermediate transfer belt 56 (S106). In addition, in a case where the determination is YES in any of the above steps S102 to S104, the controller 200 detects the surface resistivity of the intermediate transfer belt 56 detected in the resistance detection mode as the surface resistivity of the intermediate transfer belt 56 at an initial stage of use.

Next, the controller 200 detects the lifetime of the intermediate transfer belt 56 as follows based on the surface resistivity of the intermediate transfer belt 56 detected in the resistance detection mode.

Figure 8:
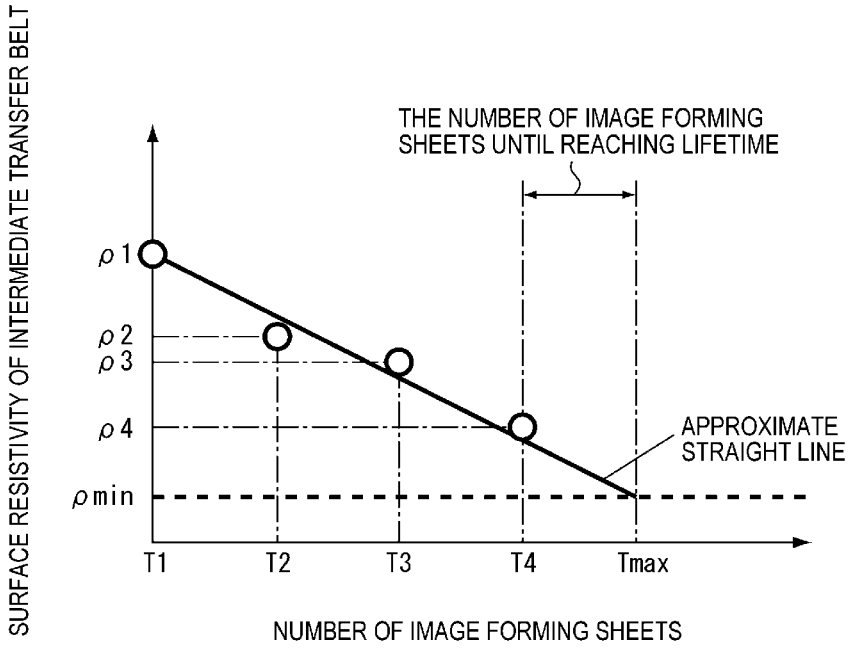
FIG. 8 is a graph showing a relationship between the number of image forming sheets and the surface resistivity of the intermediate transfer belt.

FIG. 8 is a graph showing a relationship between the number of image forming sheets and the surface resistivity of the intermediate transfer belt 56. As shown in FIG. 8, a lower limit value ρmin of the surface resistivity of the intermediate transfer belt 56 at which the intermediate transfer belt 56 can be used without possibility of spattering is previously stored in the ROM 211.

The controller 200 executes the resistance detection mode and stores in the RAM 212 all of the number of image forming sheets at the time of execution and the detected surface resistivity. For example, as shown in FIG. 8, the number of image forming sheets and the detected surface resistivity are stored such that the number of image forming sheets at the time of a first execution of the resistance detection mode is T1, and a surface resistivity of the intermediate transfer belt 56 at that time is ρ1 (a first detection result), and the number of image forming sheets at the time of a second execution is T2, and a surface resistivity at that time is ρ2 (a second detection result).

Next, from these detection results, an approximate straight line relating to the relationship between the number of image forming sheets and the surface resistivity of the intermediate transfer belt 56 is derived by the least squares method. Next, from the approximate straight line and the lower limit value ρmin of the surface resistivity, an upper limit value Tmax of the number of image forming sheets, which is the number of image forming sheets reaching the lower limit value ρmin of the surface resistivity, is calculated. Next, from difference between the upper limit value Tmax of the number of image forming sheets and the number of image forming sheets (T4 in the present embodiment) at the time of executing the resistance detection mode, the number of image forming sheets until the intermediate transfer belt 56 reaches its lifetime is calculated.

Next, in a case where the number of image forming sheets until the intermediate transfer belt 56 reaches its lifetime is more than zero, the controller 200 causes the operation display portion 201 to display the number of image forming sheets until the intermediate transfer belt 56 reaches its lifetime (S109). Note that, in a case where the number of image forming sheets until the intermediate transfer belt 56 reaches its lifetime exceeds an upper limit value of the number of image forming sheets of the image forming apparatus A previously set (in the present embodiment, 1,000,000 sheets), the upper limit value and the number of image forming sheets until the intermediate transfer belt 56 reaches its lifetime is made to be the same. Thereafter, the lifetime detection sequence ends.

On the other hand, in a case where the number of image forming sheets until the intermediate transfer belt 56 reaches its lifetime is zero or less, the controller 200 determines that the intermediate transfer belt 56 has reached its lifetime, causes the operation display portion 201 to displays a message to that effect, and urges the user to replace the intermediate transfer belt 56 (S110). Thereafter, the lifetime detection sequence ends.

That is, in the resistance detection mode, the controller 200 applies a plurality of voltages higher than the discharge starting voltage Vth from the primary transfer power supply 82 to the primary transfer roller 54, and outputs information regarding the lifetime of the intermediate transfer belt 56 based on the current flowing at that time. That is, the controller 200 refers to the discharge starting voltage derived in resistance detection mode and the correlation data shown in FIG. 4, which is previously stored in the ROM 211, detects the surface resistivity of the intermediate transfer belt 56, and reports the information regarding the lifetime of the intermediate transfer belt 56 based on the surface resistivity. Specifically, the controller 200 executes the resistance detection mode for the predetermined number of image forming sheets, and determines and reports that the intermediate transfer belt 56 has reached its lifetime in a case where the surface resistivity (an electric resistance value) of the intermediate transfer belt 56 detected in the resistance detection mode has reached the lower limit value ρmin of the preset surface resistivity. Further, the controller 200 derives the relationship between the number of image forming sheets and the surface resistivity of the intermediate transfer belt 56 from the surface resistivity of the intermediate transfer belt 56 detected a plurality of times, and calculates and reports the number of image forming sheets until the intermediate transfer belt 56 reaches its lifetime based on the derived relationship and the upper limit value or the lower limit value of the surface resistivity.

With the above configuration, the controller 200 can detect the resistance and the lifetime of the intermediate transfer belt 56 from the discharge starting voltage at which the current starts to flow through the intermediate transfer belt 56 to the photosensitive drum when a voltage is applied to the primary transfer roller 54, and can send the information regarding the lifetime. Therefore, it is possible to suppress an image defect caused by a change in electric resistance of the intermediate transfer belt 56 with an inexpensive and a simple configuration without using a material having special optical characteristics for the intermediate transfer belt 56 and the primary transfer roller 54.

Note that the lifetime detection sequence described above is a lifetime detection control in a case where the electric resistance of the intermediate transfer belt 56 decreases as the image is formed. However, depending on the environment in which the image forming apparatus A is placed and the material of the intermediate transfer belt 56, the electric resistance of the intermediate transfer belt 56 may increase as the image is formed. Therefore, in step S107 in the lifetime detection mode, the following control can be performed such that even in a case where the electric resistance of the intermediate transfer belt 56 increases, the lifetime can be similarly detected.

Figure 9:
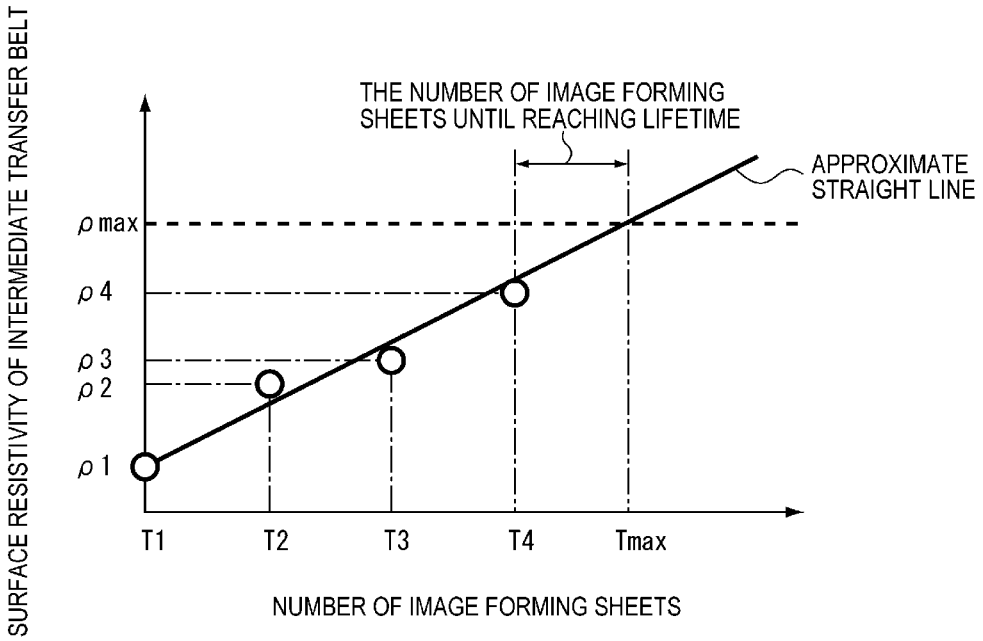
FIG. 9 is a graph showing the relationship between the number of image forming sheets and the surface resistivity of the intermediate transfer belt.
Figure 10:
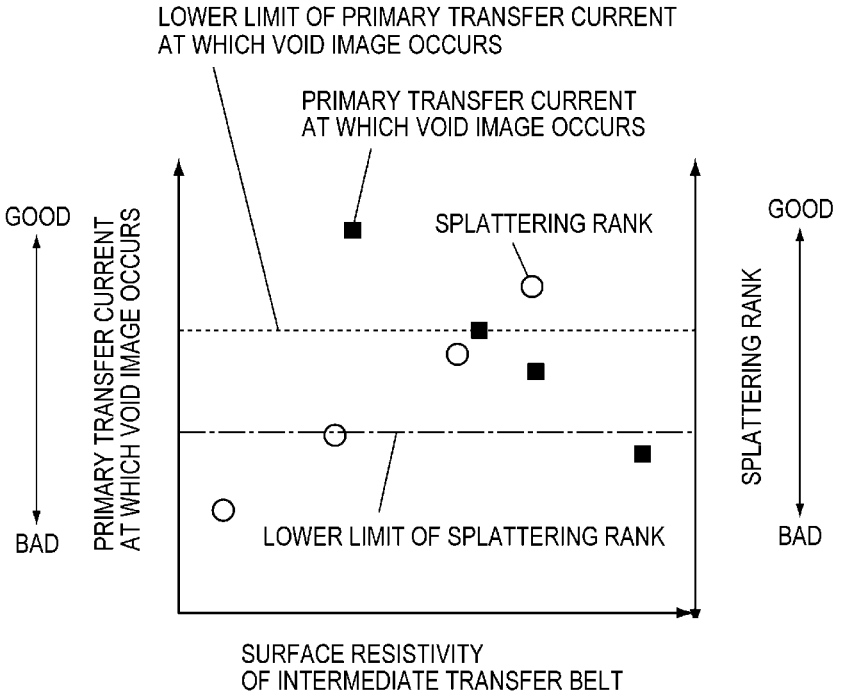
FIG. 10 is a graph showing a relationship between the primary transfer current at which a void image occurs and a splattering rank according to a difference in the surface resistivity of the intermediate transfer belt.

FIG. 9 is a graph showing a relationship between the number of image forming sheets and the surface resistivity of the intermediate transfer belt 56. As shown in FIG. 9, an upper limit value ρmax of the surface resistivity of the intermediate transfer belt 56 at which the intermediate transfer belt 56 can be used without possibility of occurrence of a void image is previously stored in the ROM 211.

As in step S107 described above, the controller 200 stores all of the number of image forming sheets and the detected surface resistivity at the execution of the resistance detection mode in the RAM 212, and derives the approximate straight line with respect to the relationship between the number of image forming sheets and the surface resistivity of the intermediate transfer belt 56 by the least squares method. Next, from the approximate straight line and the upper limit value ρmax of the surface resistivity, the upper limit value Tmax of the number of image forming sheets, which is the number of image forming sheets reaching the upper limit value ρmax of the surface resistivity, is calculated. Then, from the difference between the upper limit value Tmax and the number of image forming sheets at the time of execution of the resistance detection mode, the number of image forming sheets until the intermediate transfer belt 56 reaches its lifetime is calculated. Thereafter, control similar to that in steps S108 to S110 is performed.

As a result, even in a case where the electric resistance of the intermediate transfer belt 56 increases as the image is formed, a risk of occurrence of a void image due to local discharge can be reduced.

Note that although the full-color image forming apparatus has been described by way of example in the present embodiment, the present invention is not limited to the full-color image forming apparatus. The present invention is also applicable to a monochrome image forming apparatus. Further, although the intermediate transfer belt 56 is used as the intermediate transfer member, the present invention may adopt a configuration in which an intermediate transfer roll is used.

Further, in the present embodiment, although the information regarding the lifetime is displayed and reported on the operation display portion 201, the present invention is not limited to this configuration. That is, for example, the present invention may adopt a configuration in which a communication network (communication portion) which communicates with the external device may be used to transmit and report the information regarding the lifetime of the intermediate transfer belt 56 to the external device such as a personal computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-44170, filed Mar. 8, 2017, which is hereby incorporated by reference herein in its entirety.

What is claimed is:

1. An image forming apparatus comprising:

a photoconductor configured to carry a toner image;

an intermediate transfer belt onto which the toner image carried on the photoconductor is transferred;

a metal transfer roller which is disposed to abut an inner peripheral surface of the intermediate transfer belt such that, when viewed in a thickness direction of the intermediate transfer belt, an abutting position between the metal transfer roller and the intermediate transfer belt does not overlap an abutting position between the photoconductor and the intermediate transfer belt, the metal transfer roller being configured to transfer the toner image carried on the photoconductor to the intermediate transfer belt at a transfer position when a voltage is applied from a power supply;

a detection portion configured to detect a current flowing when a voltage is applied to the transfer roller from the power supply; and a controller capable of executing a mode in which a plurality of voltages higher than a discharge starting voltage is applied from the power supply to the transfer roller during a period other than a transfer period when the toner image carried on the photoconductor is transferred onto the intermediate transfer belt, the controller being configured to output information regarding a lifetime of the intermediate transfer belt based on a current flowing when the plurality of voltages is applied to the transfer roller.

2. The image forming apparatus according to claim 1, wherein the controller applies voltages of at least two values to the transfer roller from the power supply such that a current value detected by the detection portion is not less than a predetermined value, and outputs the information based on a relationship between the current and the voltage at that time.

3. The image forming apparatus according to claim 2, wherein the controller outputs the information based on a discharge starting voltage at which a current equal to or greater than a predetermined value starts to flow from the transfer roller to the photoconductor via the intermediate transfer belt when a predetermined voltage is applied to the transfer roller.

4. The image forming apparatus according to claim 1, wherein the controller is capable of executing the mode at different timings, and outputs the information based on a first detection result detected by the detection portion in the mode at a previous time and a second detection result detected by the detection portion in the mode at a next time.

5. The image forming apparatus according to claim 4, wherein the controller executes the mode each time image forming is performed for a predetermined number of sheets.

6. The image forming apparatus according to claim 5, further comprising a memory configured to store a relationship between a discharge starting voltage acquired in the mode and a surface resistivity of the intermediate transfer belt, wherein the controller outputs the information based on the relationship stored in the memory and a detection result detected by the detection portion in the mode.

7. The image forming apparatus according to claim 1, further comprising a display portion, wherein the controller causes the display portion to display the information regarding the lifetime of the intermediate transfer belt.

8. The image forming apparatus according to claim 1, further comprising a communication portion configured to communicate with an external device, wherein the controller transmits the information regarding the lifetime of the intermediate transfer belt to the external device using the communication portion.

9. The image forming apparatus according to claim 1, wherein the intermediate transfer belt is configured to be detachably attachable to a main body of the image forming apparatus.

* * * * *